US005542588A

United States Patent [19]

Sison

[11] Patent Number: 5,542,588

[45] Date of Patent: Aug. 6, 1996

[54] ADJUSTABLE PEN HOLDER

[76] Inventor: John P. C. Sison, 6351 San Roberto Cir., Buena Park, Calif. 90620

[21] Appl. No.: 398,454

[22] Filed: Mar. 3, 1995

[51] Int. Cl.[6] ..... B43L 15/00; A45F 5/00

[52] U.S. Cl. ..... 224/218; 224/267; 15/443

[58] Field of Search ..... 224/217, 218, 224/219, 222, 267, 901; 2/106; 15/335, 443

[56] References Cited

U.S. PATENT DOCUMENTS

| | | | |
|---|---|---|---|
| 1,872,218 | 8/1932 | Asplund | 224/218 |
| 3,503,546 | 3/1970 | Hunt | 224/218 |
| 3,629,867 | 12/1971 | Taylor | 224/219 |
| 4,148,424 | 4/1979 | Fortenberry | 224/218 |
| 4,477,005 | 10/1984 | Martinez | 224/218 |
| 4,504,980 | 3/1985 | Butcher | 2/160 |
| 4,606,484 | 8/1986 | Winter et al. | 224/218 |
| 4,662,873 | 5/1987 | Lash et al. | 224/219 |
| 5,437,399 | 8/1995 | Levitt et al. | 224/219 |

FOREIGN PATENT DOCUMENTS

| | | | |
|---|---|---|---|
| 2048475 | 2/1993 | Canada | 224/219 |
| 170823 | 5/1906 | Germany | 15/443 |
| 199831 | 6/1908 | Germany | 15/443 |
| 26937 | of 1897 | United Kingdom | 15/443 |
| 166194 | 7/1921 | United Kingdom | 224/218 |

*Primary Examiner*—Henry J. Recla
*Assistant Examiner*—Gregory M. Vidovich
*Attorney, Agent, or Firm*—Price, Gess & Ubell

[57] ABSTRACT

The present invention discloses a writing implement holder, which includes a lightweight strap loosely wrapped around the user's wrist. The strap can be loosely wrapped around the user's palm because of a rigid extension connected to the strap. The right extension wraps around a portion between the user's thumb and wrist, and provides stability and support to the entire writing implement holder. Simple slots are placed in the flexible strap for accommodating a writing implement at any of a number of different orientations and positions. Thus, the writing implement holder of the present invention reduces discomfort and perspiration by providing a lightweight and loose-fitting configuration.

20 Claims, 2 Drawing Sheets

ADJUSTABLE PEN HOLDER

BACKGROUND OF THE INVENTION

1. Field of the Invention

The present invention generally relates to a strap for securing a writing implement to a user's hand.

2. Description of Related Art

The prior art has made several attempts at providing an apparatus for securing a writing implement to a user's hand when the writing implement is not in use. U.S. Pat. No. 4,148,424 to Fortenberry discloses a flexible holder for a writing instrument. This holder comprises a band and a clip means, as shown in FIG. 1 of that patent. The strap must be secured tightly around the user's hand and, further, when the pencil is rotated to a writing position (FIG. 2), the strap tightens around the user's hand, causing discomfort and perhaps restricting circulation. Another patent, U.S. Pat. No. 4,602,885 to Bischoff et al., discloses a holding cuff for the disabled. The cuff rigidly holds a pen in a single position so that a disabled person can write, and is neither comfortable nor adaptable for use of the hand when the pencil is in a nonused position.

U.S. Pat. No. 371,814 to H. W. Bearce discloses a hand rest comprising a solid cylindrical member "a" and an elastic flexible member "b" (FIG. 1). The structure of this hand rest does not provide a neutral position for the writing implement when the writing implement is not being used. Another device for attaining correct position of pens when writing is disclosed in U.S. Pat. No. 621,472 to J. Fibrig. This apparatus comprises a first portion "c" that wraps around the user's fingers, and a second portion "a" which wraps around the user's thumb. The device is used to correct handwriting, and comprises a swivel "$e^2$" and a U-bolt "$e^3$" for holding the pen. The metallic parts and various loops of this apparatus are both complex and burdensome.

The writing implement holder disclosed in U.S. Pat. No. 3,503,546 to A. W. Hunt discloses a rigid strap 16 which wraps around a user's entire hand. The strap restricts movement, and further includes complex metal components for holding the writing implement. These components include elements 23–25 for pivotally holding a writing implement 15 in both a writing position and in a nonuse position where the writing implement 15 is held against the user's palm.

A final device disclosed in U.S. Pat. No. 4,606,484 to Winter et al. discloses a tool-holding apparatus for people with limited use of their hands. The apparatus comprises a flexible strap 50 in a fixed body 10 for rotatably holding a tool, such as a toothbrush. The strap 50 must be tightly secured about the user's wrist, and the fixed body 10 is large and cumbersome.

The prior art has thus made several attempts at holding instruments in both active and nonactive positions, but has not provided a comfortable, simple, and lightweight design which can hold a tool in a variety of locations and orientations on the user's hand.

SUMMARY OF THE INVENTION

The present invention discloses a writing implement holder, which includes a lightweight strap loosely wrapped around the user's wrist. The lightweight strap can be loosely wrapped around the user's palm because of a rigid extension connected to the strap. This rigid extension wraps around a portion between the user's thumb and wrist, and provides stability and support to the entire writing implement holder.

Simple slots are placed in the lightweight strap for accommodating a writing implement at any of a number of different orientations and locations. Thus, the writing implement holder of the present invention may reduce discomfort and perspiration by providing a lightweight and loose-fitting configuration.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically.

Figure 1:
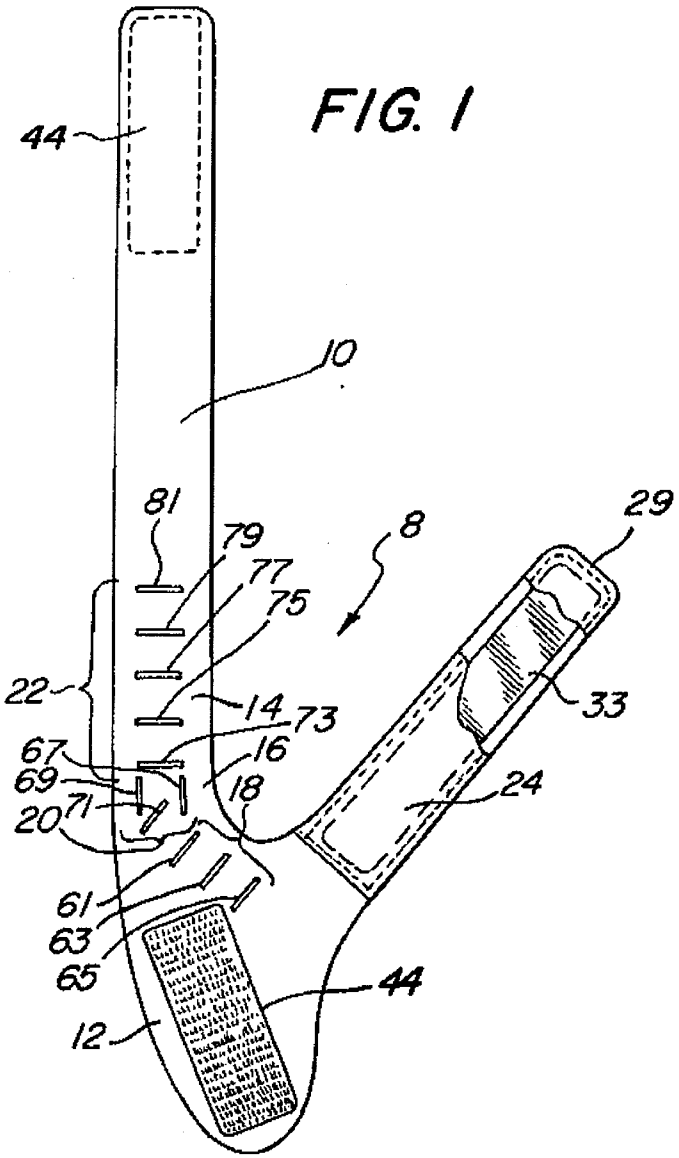
FIG. 1 illustrates a bottom plan view of the writing implement holder of the presently preferred embodiment.

The writing implement holder 8 of the presently preferred embodiment is shown in FIG. 1. The writing implement holder 8 generally comprises a wrapping means 10 and a thumb contacting means 24. The thumb contacting means 24 comprises a rigid member 33 placed within the fabric of the thumb contacting means 24. While the thumb contacting means 24 preferably embodies fabric encircling a rigid member 33, other configurations are possible. For example, the thumb contacting means 24 may comprise a semirigid member or no rigid member at all. Additionally, the thumb contacting means 24 may comprise an element fully encircling the user's thumb and connecting at a remote end 29 to a portion of the wrapping means 10.

As presently embodied, the wrapping means 10 comprises a back side portion 12 which as shown in the figures fits around the back side of a user's hand above the user's fingers and secures the writing implement holder 8 together using a hook and loop fastener such as Velcro® 44 or some other fastening means. In this presently preferred embodiment, the wrapping means 10 further comprises a palm portion 14 which fits across the user's palm, and a thumb-forefinger portion 16 which fits generally between the user's thumb and forefinger. In the presently preferred embodiment, the writing implement holder 8 comprises a lightweight, flexible material such as neoprene foam/nylon.

The writing implement holder 8 of the presently preferred embodiment further comprises a first securing means 18, a second securing means 20, and a third securing means 22. The first securing means 18 comprises a plurality of apertures. In the presently preferred embodiment, these apertures comprise a first slot 61, a second slot 63, and a third slot 65.

These slots can accommodate a writing implement. A writing implement, such as a pencil, can be inserted into a first one of these slots and back out of a second one of these slots to flexibly hold the writing implement to the writing implement holder 8. Since the fabric of the writing implement holder 8 is flexible, the writing implement can be twisted about any two slots, and thereby moved into a writing position or a nonwriting position.

The second securing means 20 comprises a plurality of slots for holding a writing implement in a second area which is generally located between a user's thumb and forefinger. The second securing means 20 preferably comprises two parallel slots and a diagonal slot therebetween. This second securing means is presently embodied as a fourth slot 67, a fifth slot 69, and a sixth slot 71.

Figure 3:
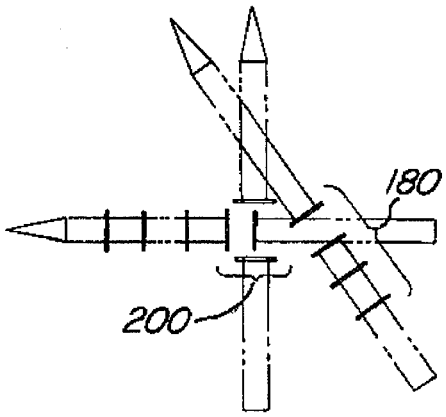
FIG. 3 shows an alternative embodiment of the present invention.

In an alternative embodiment shown in FIG. 3, the second securing means 200 comprises a first number of parallel slots and a second number of slots perpendicular to the first slots. In this embodiment, all of the slots in the second securing means 200 are diagonal to the slots in the first securing means 180. Other orientations of slots may be used, according to preference.

In the presently preferred embodiment shown in FIG. 1, the third securing means 22 comprises a series of parallel slots 73, 75, 77, 79, and 81. This third securing means 22 fits across the palm of a user's hand and, accordingly, is adapted to hold a writing implement in the user's palm when the writing implement is not in use.

Figure 2:
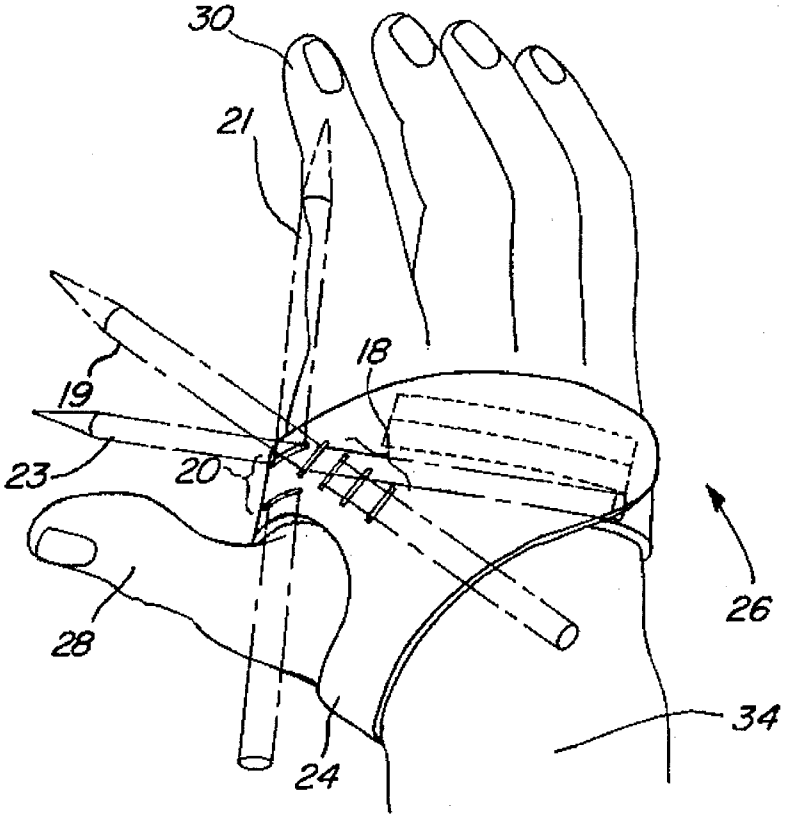
FIG. 2 is a first perspective view of the writing implement holder of the presently preferred embodiment.

FIG. 2 shows the writing implement holder 8 secured to a user's hand 26. Slots 61 and 63 of the first securing means 18 are shown holding a writing implement 19 in a nonuse position. When the user wishes to use the writing implement 19, the user's forefinger 30, for example, can grab a portion of the writing implement 19 and pull the writing implement 19 into a writing position.

Slots 67 and 69 of the second securing means 20 are shown holding a writing implement 21 in a nonuse orientation which is generally parallel to the user's fingers. Slots 69 and 71 of the second securing means 20 are shown holding a writing implement 23 in an orientation somewhat perpendicular to the user's fingers. In either of these orientations, the user can grab the writing implement 19 and pivot the writing implement 19 into a writing position. The three writing implements 19, 21, and 23 are shown in phantom, since usually a user has only a single writing implement secured to the writing implement holder 8 at any given time.

Figure 4:
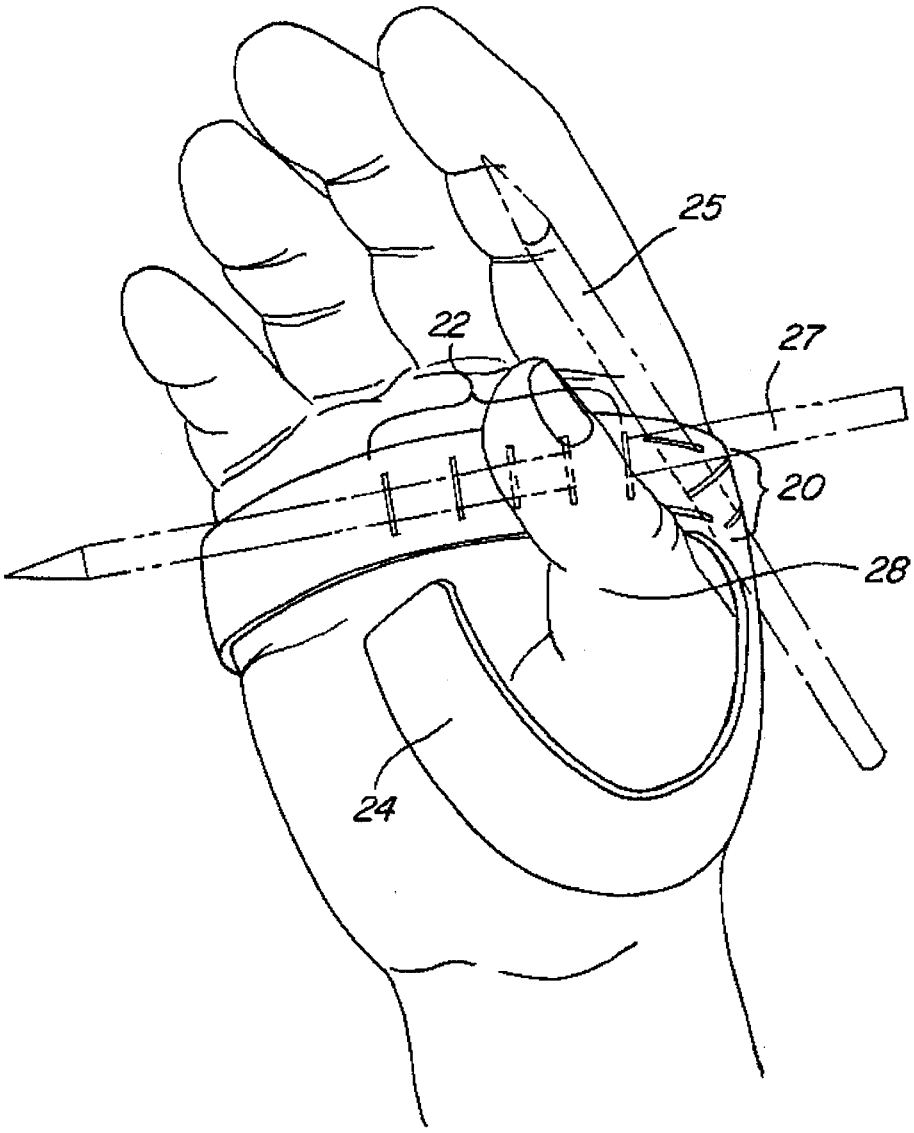
FIG. 4 is a second perspective view of the writing implement holder of the presently preferred embodiment.

As shown in FIG. 4, the thumb contacting means 24 wraps around a proximal base portion of the user's thumb 28. This thumb contacting means 24 provides sufficient support to the writing implement holder 8 to allow the wrapping means 10 to be loosely secured about the user's hand. The thumb contacting means 24 does not need to wrap completely around the user's thumb. The unique combination of a flexible wrapping means 10 and a rigid thumb contacting means 24 provides a lightweight and inexpensive configuration.

The thumb contacting means 24 draws support from a portion of the user's hand which is remote from the user's fingers, thereby not getting in the way. The writing implement 25 shown in FIG. 4 can pass through only a single one of the slots of the second securing means 20 for quick insertion and removal. FIG. 4 shows the writing implement 25 passing only through the fifth slot 69. According to an alternative embodiment, the wrapping means may comprise only a single slot or aperture. Another writing implement 27 is shown inserted through slots 73 and the third securing means 22.

Some users who are required to write and type throughout the day may prefer not to wear a tight-fitting wrapping means 10. Thus, a wrapping means 10 which fits loosely to avoid restricting movement and perspiration is advantageous. Additionally, a loose-fitting wrapping means 10 does not restrict circulation or press too tightly against the skin.

While the thumb contacting means 24 provides support and allows the wrapping means 10 to be loosely secured to the user's hand, the thumb contacting means 24 is not necessary. For example, a simple wrapping means 10 with one or more slots therein is even more lightweight than Applicant's presently preferred embodiment. Some users may prefer a lighter wrapping means (without the thumb contacting means) wrapped tighter than the loose-fitting wrapping means of the presently preferred embodiment (with the thumb contacting means 24).

In the presently preferred embodiment, the rigid member 33 within the thumb contacting means 24 can be bent to loosely or tightly fit around the user's thumb, according to preference. This second dimension of adjustability has been lacking in the prior art. Additionally, the slots of the presently preferred embodiment which allow a writing implement to be held via a single slot, two slots, or more slots to provide various levels of stability and flexibility has been lacking in the prior art. The prior art has not recognized and has not disclosed any writing implement holder which holds a writing implement between a user's thumb and forefinger in either a direction parallel to the user's fingers or a direction perpendicular to the user's fingers. The first securing means 18 of the presently preferred embodiment for holding a writing implement close to the back side portion of a user's hand has not been disclosed in the prior art.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A writing implement holder, comprising:

wrapping means for loosely wrapping around a user's hand without interfering with any fingers of the user's hand, the wrapping means comprising a backside portion extending around a backside of the user's hand, a palm portion extending across a palm of the user's hand above the user's fingers, and a thumb-forefinger portion extending between a thumb of the user's hand and a forefinger of the user's hand above the user's forefinger;

at least one securing means for securing a writing implement to an area on the writing implement holder; and thumb-contacting means for contacting the user's thumb to draw support for the wrapping means therefrom without interfering therewith, the thumb-contacting means extending from the backside portion of the wrapping means around a base portion of the user's thumb that is located between a proximal knuckle of the user's thumb and a wrist of the user, wherein the thumb-contacting means is substantially C-shaped and only a proximal end thereof is connected to the wrapping means.

2. The writing implement holder of claim 1, further comprising another securing means for securing a writing implement to another area on the writing implement holder, the other securing means being located on the palm portion of the wrapping means.

3. The writing implement holder of claim 1, wherein the thumb-contacting means is rigid.

4. The writing implement holder of claim 3, wherein the thumb-contacting means can be bent and adjusted to comfortably fit the thumb portion of an individual user.

5. The writing implement holder of claim 4, wherein the thumb-contacting means can be adjusted to tightly grip the thumb portion of a user for support, or can be adjusted to loosely grip the thumb portion of the user for comfort.

6. The writing implement holder of claim 5, wherein the thumb-contacting means grips the user's hand sufficiently to allow the wrapping means to be loosely secured about the user's hand.

7. The writing implement holder of claim 6, wherein the thumb-contacting means, when adjusted to loosely grip the thumb portion of the user for comfort, minimizes perspiration between the user's hand and the writing implement holder.

8. A writing implement holder, comprising:

wrapping means for loosely wrapping around a user's hand without interfering with any fingers of the user's hand, the wrapping means wrapping around the user's hand above the user's fingers and crossing between the user's forefinger and thumb:

thumb-contacting means for retaining the wrapping means around the user's hand above the user's fingers without interfering with the user's thumb, the thumb-contacting means extending from the wrapping means around a base portion of the user's thumb located between a proximal knuckle of the user's thumb and a wrist of the user; and securing means for selectably securing a writing implement to the writing implement holder in one of a plurality of different discrete orientations relative to the writing implement holder, the securing means comprising slots in the wrapping means, the slots extending from an upper surface of the wrapping means to a lower surface of the wrapping means.

9. The writing implement holder of claim 8, wherein the wrapping means comprises two ends which can be fastened together with corresponding hook and loop fasteners.

10. A writing implement holder, comprising:

wrapping means for loosely wrapping around a user's hand without interfering with any fingers of the user's hand, the wrapping means wrapping around the user's hand above the user's fingers and between the user's forefinger and thumb;

means for retaining the wrapping means around the user's hand above the user's fingers; and a plurality of securing means located at a corresponding plurality of different locations along the wrapping means, for securing a writing implement to the wrapping means at any of the plurality of different locations, including:

a first set of slots for securing a writing implement to a first area on the writing implement holder, the first set of slots being located approximately between the thumb-forefinger portion and the backside portion of the wrapping means:

a second set of slots for securing a writing implement to a second area on the writing implement holder, the second set of slots being located approximately between the thumb-forefinger portion and the palm portion of the wrapping means, the second set of slots comprising a first subset of slots and a second subset of slots diagonal to the first subset of slots; and a third set of slots for securing a writing implement to a third area on the writing implement holder, the third set of slots being located on the palm portion of the wrapping means.

11. The writing implement holder of claim 10, wherein the plurality of securing means comprises a plurality of slots in the wrapping means, the plurality of slots located generally between the user's thumb and forefinger.

12. The writing implement holder of claim 10, wherein the first set of slots comprises slots which are diagonal to both the first and second subsets of slots.

13. The writing implement holder of claim 12, wherein the third set of slots comprises slots which are parallel to the second subset of slots.

14. A writing implement holder, comprising:

wrapping means for loosely wrapping around a user's hand without interfering with any fingers of the user's hand, the wrapping means comprising an inner surface that contacts the user's hand and an outer surface opposite the inner surface, the wrapping means wrapping around the user's hand above the user's fingers and forefinger crossing between the user's forefinger and thumb;

retaining means extending from the wrapping means, said retaining means adapted to engage the user's thumb for retaining the wrapping means around the user's hand above the user's fingers; and at least one aperture in the wrapping means, the aperture extending from the outer surface through the wrapping means to the inner surface, the aperture being located generally between any of the user's fingers and the user's thumb adapted to accommodate a writing implement therein.

15. The writing implement holder of claim 14, wherein a first portion of the writing implement is adapted to contact both the inner surface of the wrapping means and the user's hand, and a second portion of the writing implement is adapted to contact the outer surface of the wrapping means and extends away from the user's hand.

16. The writing implement holder of claim 14, wherein the aperture comprises a slot.

17. The writing implement holder of claim 14, wherein the at least one aperture comprises a plurality of slots for accommodating a writing implement by weaving the writing implement in one slot and out of another slot.

18. The writing implement holder of claim 14, wherein the wrapping means comprises a flexible material.

19. A writing implement holder for holding a writing implement having a writing tip, the writing implement holder adapted to be secured about a user's hand such that it does not contact the user's fingers except for the user's thumb, the writing implement bolder comprising:

wrapping means for loosely wrapping around a user's hand without interfering with any fingers of the user's hand, the wrapping means comprising a backside portion extending around a backside of the user's hand above the user's fingers, a palm portion extending across a palm of the user above the user's fingers, and a thumb-forefinger portion extending between a thumb of the user and a forefinger of the user above the user's forefinger;

retaining means extending from the wrapping means, said retaining means adapted to engage the user's thumb for retaining the wrapping means around the user's hand above the user's fingers; and securing means for securing a writing implement to the wrapping means between the thumb-forefinger portion and the backside portion such that the writing tip of the writing implement is movably held between the user's forefinger and the user's thumb and the user may write with the writing tip.

20. The writing implement holder of claim 19, further comprising a second securing means for securing a writing implement to the writing implement holder, located approximately between the thumb-forefinger portion and the palm portion.

* * * * *